US005551192A

United States Patent [19]

Avendano et al.

[11] Patent Number: 5,551,192

[45] Date of Patent: Sep. 3, 1996

[54] REFRIGERATOR DOOR SEAL ASSEMBLY

[75] Inventors: Jose G. Avendano, Galesburg; Robert Katz, Barrington; Scott R. Voll, Galesburg, all of Ill.

[73] Assignee: Maytag Corporation, Newton, Iowa

[21] Appl. No.: 405,830

[22] Filed: Mar. 17, 1995

Related U.S. Application Data

[63] Continuation-in-part of Ser. No. 89,507, Jul. 21, 1993, abandoned.

[51] Int. Cl.[6] ..... E06B 7/16

[52] U.S. Cl. ..... 49/484.1; 49/479.1; 49/489.1; 49/496.1; 312/296; 312/405

[58] Field of Search ..... 49/484.1, 496.1, 49/478.1, 489.1, 492.1, 495.1, 479.1; 312/296, 405, 405.1

[56] References Cited

U.S. PATENT DOCUMENTS

| | | | |
|---|---|---|---|
| 513,302 | 1/1894 | Canda . | |
| 866,439 | 9/1907 | Canio . | |
| 2,068,532 | 1/1937 | Boddy . | |
| 2,084,204 | 6/1937 | Knight . | |
| 2,190,954 | 2/1940 | Stickel . | |
| 2,234,773 | 3/1941 | Orcutt . | |
| 2,247,949 | 7/1941 | Kucher . | |
| 2,276,742 | 3/1942 | Schmidt . | |
| 2,502,219 | 3/1950 | James . | |
| 2,591,003 | 4/1952 | Philipp . | |
| 2,663,916 | 12/1953 | Millman . | |
| 2,899,238 | 8/1959 | Swanson | 49/479.1 X |
| 3,078,134 | 2/1963 | Haynes, Jr. . | |
| 3,217,921 | 11/1965 | Frehse | 49/479.1 X |
| 3,276,167 | 10/1966 | Bus et al. . | |
| 3,633,316 | 1/1972 | Belser . | |
| 3,750,333 | 11/1973 | Vance . | |
| 4,617,759 | 10/1986 | Pasqualini et al. . | |
| 4,720,936 | 1/1988 | Ellingson . | |
| 5,095,657 | 3/1992 | Marsh . | |
| 5,107,622 | 4/1992 | Fuchs et al. . | |
| 5,117,587 | 6/1992 | Doan . | |
| 5,269,099 | 12/1993 | Kennedy et al. . | |
| 5,297,360 | 3/1994 | Besore et al. . | |

*Primary Examiner*—Philip C. Kannan
*Attorney, Agent, or Firm*—Bacon & Thomas

[57] ABSTRACT

A seal assembly for use between a door and a cabinet of a refrigerator includes primary and secondary seals that are preferably carried by the door and extend around the entire perimeter thereof. The secondary seal is specifically designed to minimize necessary closing forces and creates an air cell in a throat area between a cold storage compartment of the refrigerator and the primary seal in order to effectively reduce heat transfer therethrough.

20 Claims, 4 Drawing Sheets

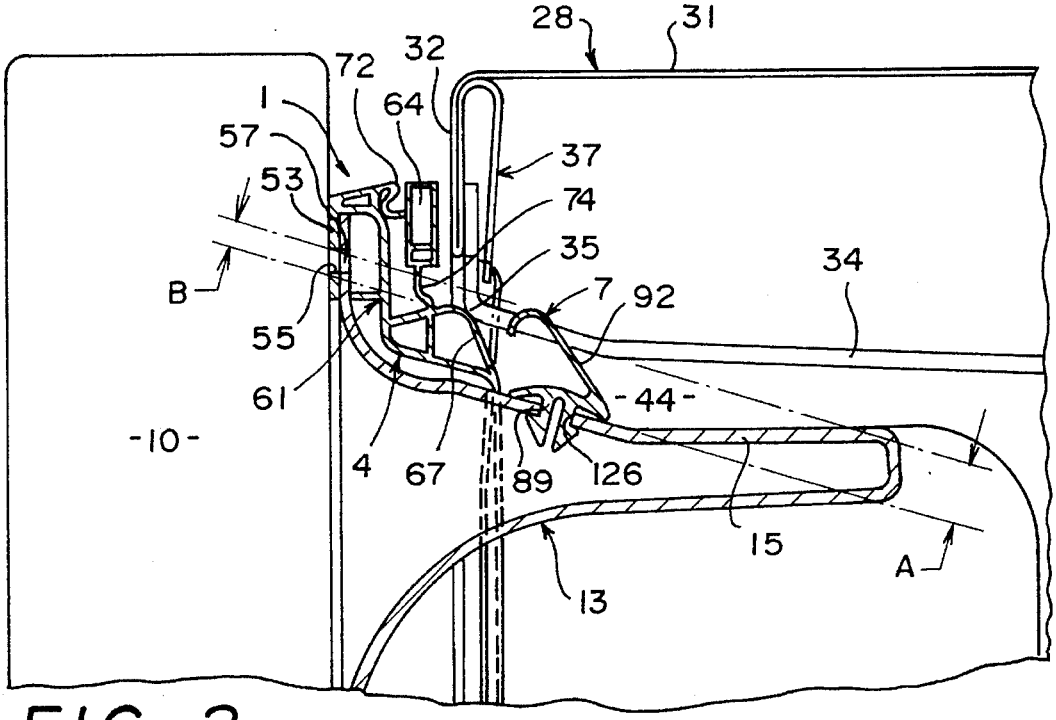
FIG. 2
FIG. 3
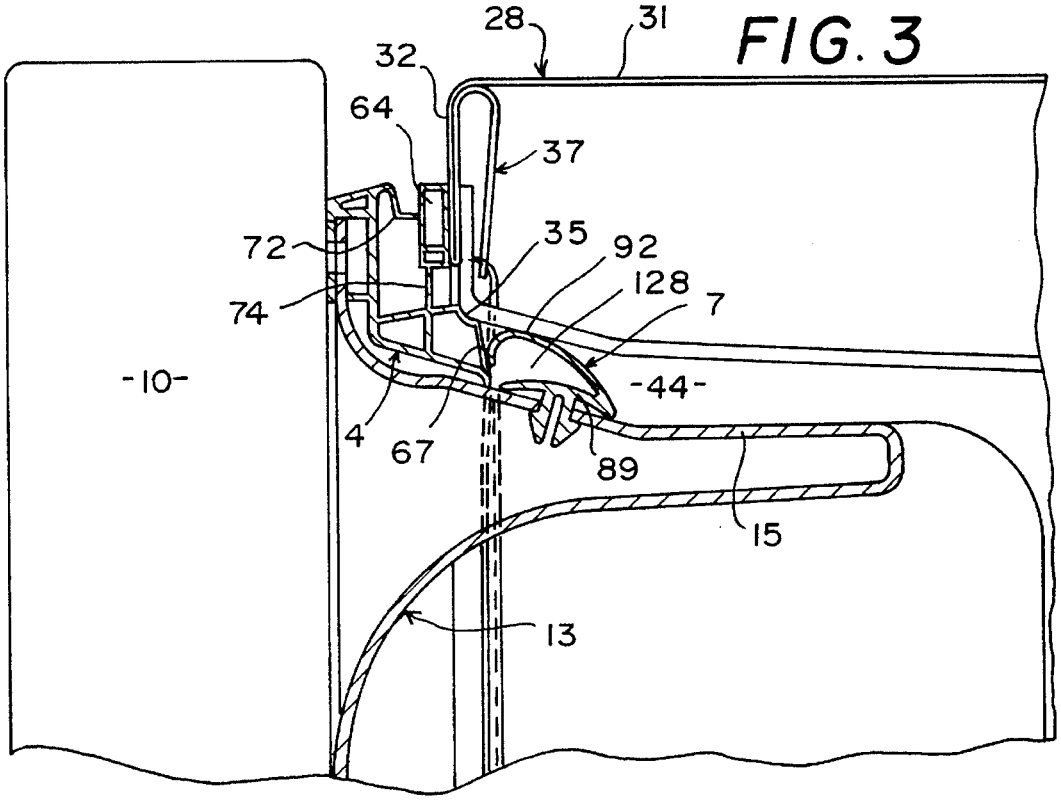

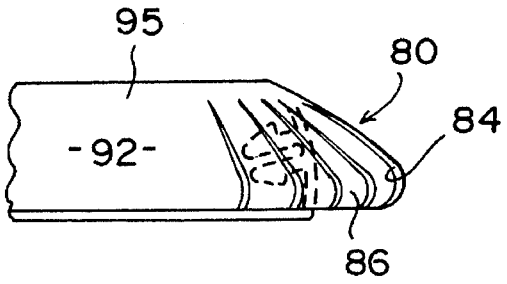
FIG. 8
FIG. 9
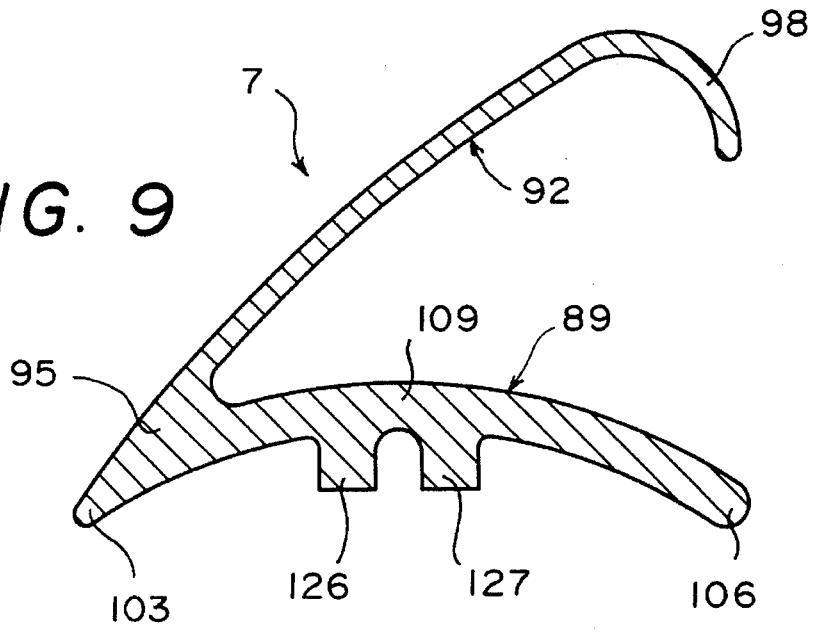
FIG. 10
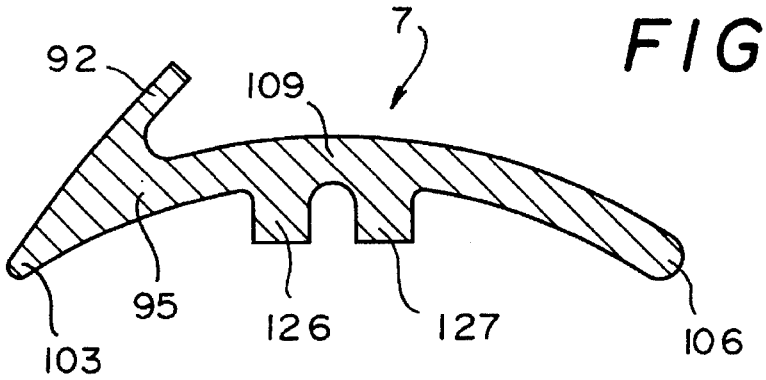

REFRIGERATOR DOOR SEAL ASSEMBLY

BACKGROUND OF THE INVENTION

This application is a continuation-in-part of Ser. No. 08/089,507 filed Jul. 21, 1993 now abandoned.

1. Field of the Invention

The present invention pertains to the art of refrigerators and, more specifically, to a seal assembly including primary and secondary seals for sealing a pivotable door to a refrigerator cabinet in an energy efficient manner.

2. Discussion of the Prior Art

It has always been a consideration to reduce energy losses in a refrigerator and, in particular, through the door seals. In recent years, as government established energy efficiency standards have become increasingly more stringent, interest in the development of energy efficient sealing arrangements have dramatically increased.

Despite numerous attempts to develop a highly effective seal arrangement, there still exists a need in the art for a sealing assembly that will meet or exceed pending government standard increases. Some attempts in energy enhancement designs have been directed to providing a secondary seal in combination with a primary seal between a refrigerator door and cabinet. In general, this concept has great merit, but known prior art seal designs of this type have been less than satisfactory. In designing an effective and successful sealing assembly, many factors, including energy savings, cost effectiveness, manufacturability, customer appeal, useful life and door closing force considerations, must be addressed.

For example, of major concern is the force required to close a refrigerator door due to the presence of a secondary seal. If the door closing force is too high, the door may actually remain ajar even when an attempt has been made to close it. Conversely, since an interference fit between the seal and a portion of the cabinet must exist to effectively minimize heat transfer through the seal, the required closing force cannot be too low.

SUMMARY OF THE INVENTION

It is an object of the present invention to provide a refrigerator door seal assembly that substantially increases the energy efficiency of the refrigerator.

It is another object of the invention to provide an effective seal assembly having a low associated closing force, a long useful life and a large operating temperature range.

These and other objects of the invention are accomplished by providing a refrigerator door seal assembly for use in a refrigerator having a cabinet shell, a shell liner, a door connected to the cabinet shell for pivotal movement between open and closed positions and a door liner secured to the door. When the door is closed, a throat area is defined between the shell liner and a dike portion of the door liner. The seal assembly includes primary and secondary seals. When the refrigerator door is closed, the primary seal is engaged between the door and at least one of the cabinet shell and the shell liner. The secondary seal has a substantially V-shaped cross-section defined by two legs, with one leg being secured to the dike portion of the door liner and the other leg being deflectable relative to the first leg from a non-sealing position to a sealing position upon contact with the cabinet liner, within the throat area, when the door is closed.

According to the invention, the secondary seal extends around the entire throat area when in its sealing position so as to provide a continuous, annular seal and to minimize convective air flow in the throat area by forming a separate air cell between the primary and secondary seals. The secondary seal also shields the throat area and primary seal from the cold refrigerator compartment temperature. In addition, the secondary seal forms a cosmetic extension of the primary seal.

Addition objects, features and advantages of the invention will become more readily apparent from the following detailed description of a preferred embodiment thereof, when taken in conjunction with the drawings wherein like reference numerals refer to corresponding parts in the several views.

BRIEF DESCRIPTION OF THE DRAWINGS

FIG. 2 is a partial, cross-sectional side view of a refrigerator depicting the seal assembly of the invention in a non-sealing position.

FIG. 3 is a partial, cross-sectional side view of a refrigerator corresponding to that depicted in FIG. 2 wherein the seal assembly is in a sealing position.

FIG. 8 is a perspective view of a corner section of the secondary seal illustrated in FIG. 4.

FIG. 9 is a cross-sectional view generally taken along line IX—IX in FIG. 4.

FIG. 10 is a cross-sectional view generally taken along line X—X in FIG. 4.

DETAILED DESCRIPTION OF THE INVENTION

Figure 1:
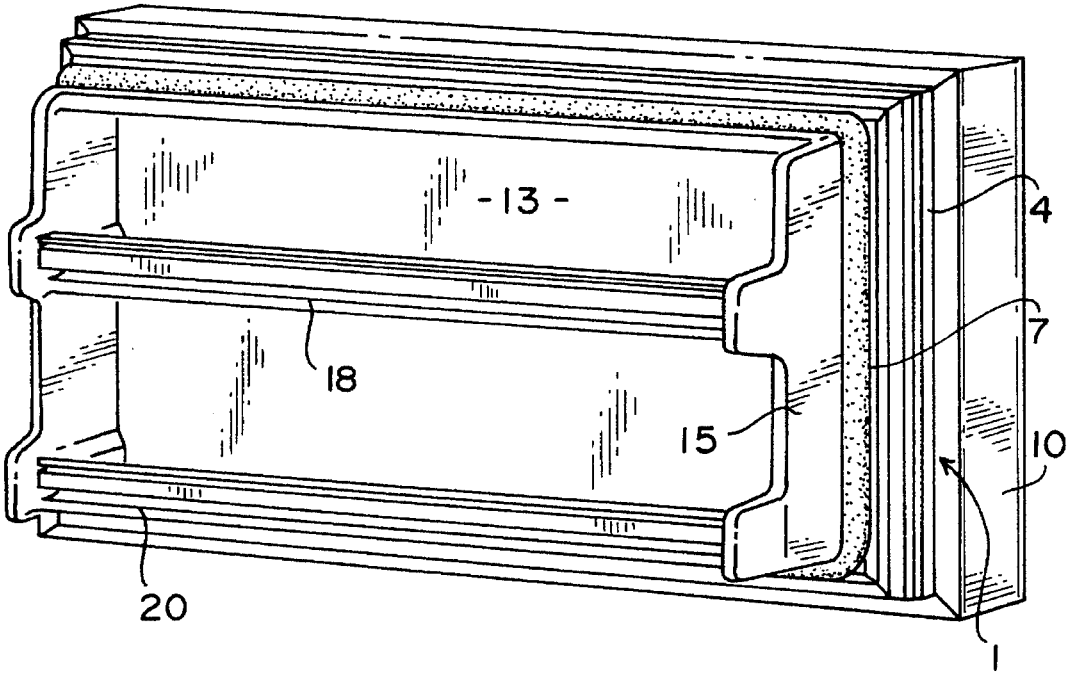
FIG. 1 is a perspective view of a refrigerator door incorporating the seal assembly of the invention.

With initial reference to FIG. 1, the seal assembly of the invention is generally indicated at 1 and includes a primary seal 4 and a secondary seal 7. In the preferred embodiment shown, seal assembly 1 is attached to a freezer door 10 of a refrigerator, but may also be utilized with the fresh food compartment door of the refrigerator. Door 10 carries a liner 13 including a dike portion 15 that defines various vertically arranged shelves 18, 20. As indicated in FIG. 1, both primary seal 4 and secondary seal 7 extend around the entire perimeter of their respective door portions for the reasons which will be more fully discussed below.

Reference will now be made to FIGS. 2 and 3 in describing the interrelationship between seal assembly 1 and a metal cabinet 28 of a refrigerator to which door 10 is pivotally mounted in a manner known in the art. Cabinet 28 is defined by a cabinet shell 31 which includes a front face portion 32. A cabinet liner 34 is carried by cabinet shell 31 and includes an associated annular forward corner 35. Liner 34 is attached to cabinet shell 31 by a return flange arrangement, generally indicated at 37, in a manner known in the art. When door 10 is closed, dike portion 15 extends within cabinet 28 so as to define a throat area 44, with cabinet shell 34, having an associated width A. Throat area 44 is designed so as to be uniform around the entire door so that secondary seal 7 can be constructed with a constant cross-section.

Primary seal 4 includes a mounting portion 53 that extends between liner 13 and door 10. Mounting portion 53 is provided with a plurality of circumferentially spaced apertures 55 that are aligned with corresponding apertures 57 formed in liner 13. Each set of apertures 55 and 57 are adapted to receive a respective fastener, such as a screw (not shown), for fixedly securing both liner 13 and primary seal 4 to door 10. Primary seal 4 further includes a support matrix, generally indicated at 61, a first seal element 64 and a second seal element 67. First seal element 64 is interconnected to support matrix 61 by flexible connection flaps 72 and 74. In the preferred embodiment shown, first seal element 64 houses a magnet (not shown) which is adapted to shift from a non-sealing position as represented in FIG. 2 to a sealing position in which first seal element 64 is removably attached to face portion 32 of cabinet shell 31, as shown in FIG. 3. In addition, when in a sealing position, second seal element 67 abuts and is deflected inwardly by annular corner 35 of liner 34. For this purpose, second seal element 67 is made more pliable than support matrix 61 to which it is attached.

As mentioned above and shown in FIGS. 2 and 3, secondary seal 7 is adapted to extend across and annularly about the entire throat area 44 so as to minimize convective air flow in throat area 44 and to isolate primary seal 4, as well as a portion of throat area 44, from the cold refrigeration temperatures present within cabinet 28.

Figure 4:
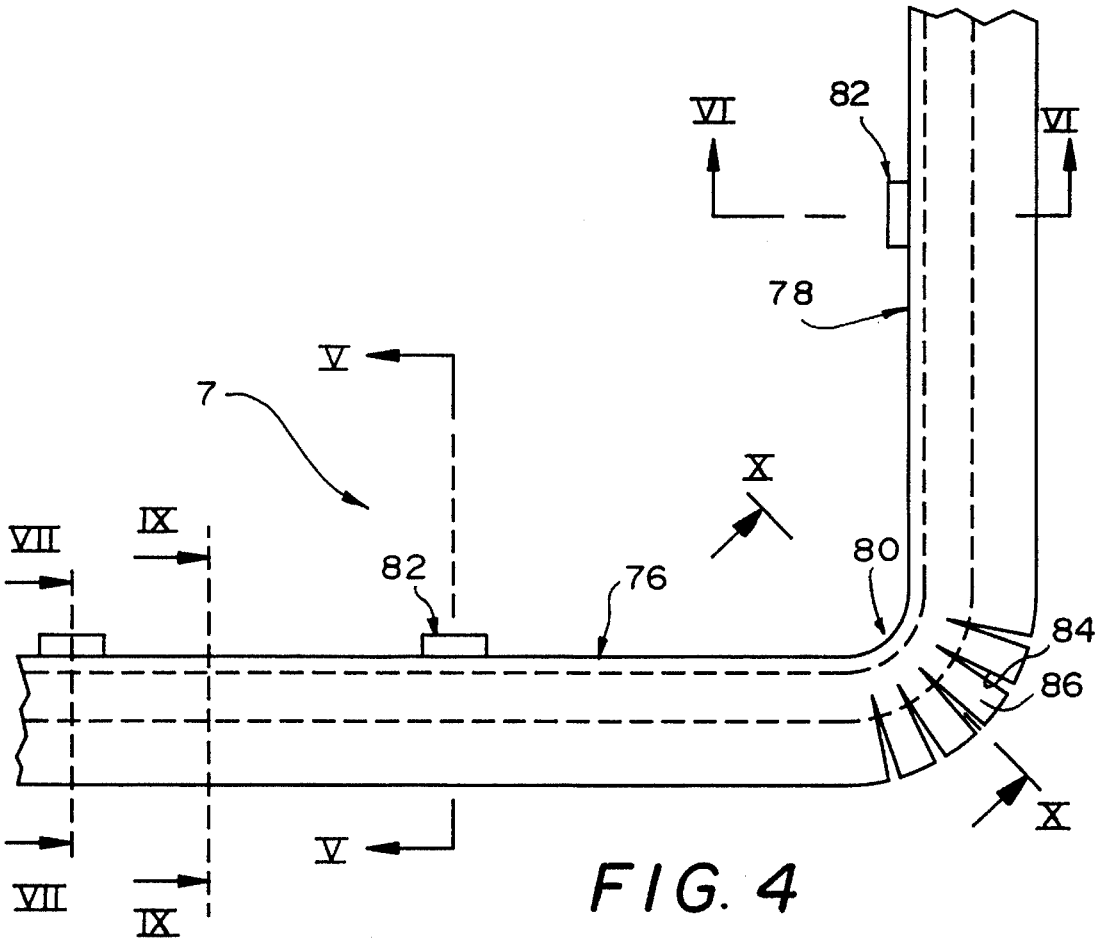
FIG. 4 is a planar view of a portion of a secondary seal incorporated in the seal assembly of the invention.

The particular construction of secondary seal 7 will now be described in detail with initial reference to FIGS. 4–6. As stated above, secondary seal 7 is preferably annular so that it can extend entirely within throat area 44. For this purpose, secondary seal 7 is preferably rectangular in shape and includes a pair of opposing, generally horizontal extending portions and a pair of opposing, generally vertical extending portions that are interconnected by corner sections. FIG. 4 illustrates a portion of secondary seal 7 with one generally horizontally extending portion being indicated at 76, one generally vertical extending portion being indicated at 78 and an interconnecting corner section being indicated at 80. Secondary seal 7 is preferably secured to dike portion 15 at connection zones 82 in the manner which will be more fully discussed below. In order to ensure minimal closing force requirements, each corner section 80 is formed with a plurality of generally V-shaped notches 84 such that, at corner section 80, secondary seal 7 defines a plurality of cantilevered arms 86. The importance of providing notches 84 and cantilevered arms 86 will be emphasized more fully below in discussing the advantageous design of the seal assembly of the present invention as it pertains to minimizing closing forces while effectively contributing to the overall energy efficiency of the refrigerator.

Figure 7:
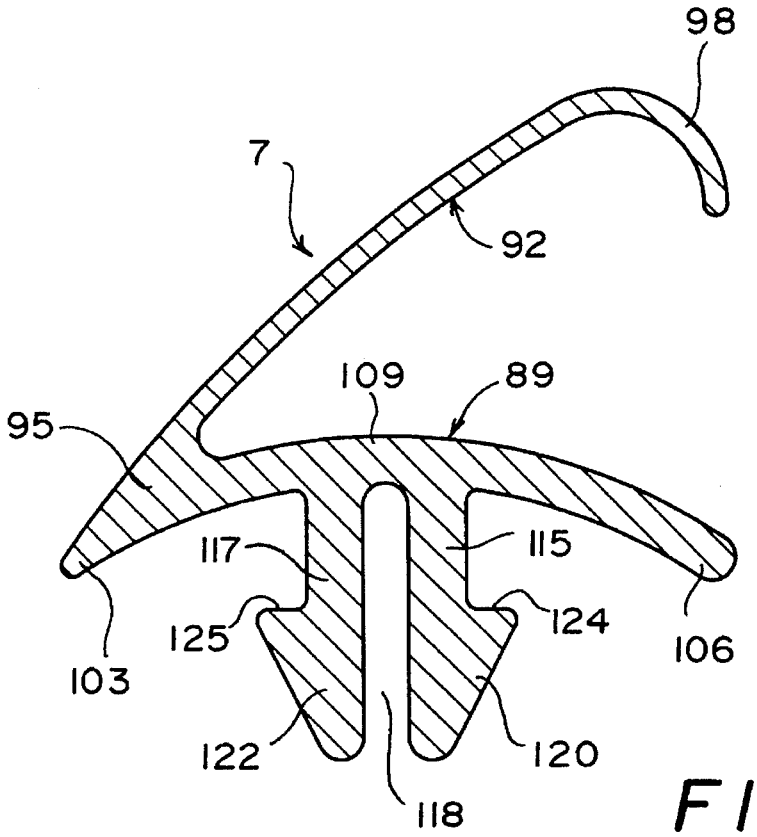
FIG. 7 is a cross-sectional view taken along line VII—VII in FIG. 4.

As best shown in FIGS. 7–9, secondary seal 7 is generally V-shaped in cross-section and includes a first leg 89, a second leg 92 and a vertex defining portion 95 interconnecting first and second legs 89, 92. Second leg 92 has an end 98, remote from vertex defining portion 95, that is curled inward toward first leg 89. First leg 89 includes first and second ends 103, 106 that are interconnected by a generally concave body portion 109. At each connection zone 82 as illustrated in FIG. 7, a pair of pliable connection members 115 and 117 that are spaced by an elongate gap 118 depend from a central section of body portion 109. Each of the connection members 115, 117 includes a respective flared end 120, 122 that combine to form an arrow-like cross-section as clearly shown in FIG. 7. Flared ends 120 and 122 define respective engagement surfaces 124 and 125.

Figure 5:
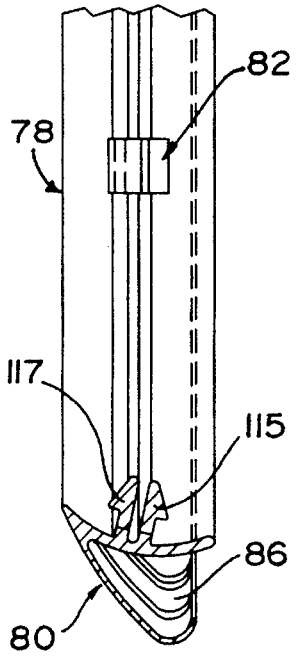
FIG. 5 is a cross-sectional view taken along line V—V in FIG. 4.
Figure 6:
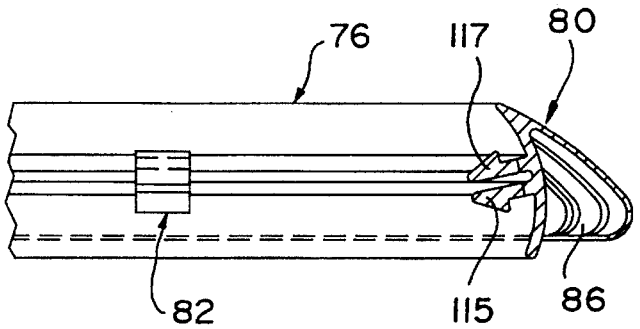
FIG. 6 is a cross-sectional view taken along line VI—VI in FIG. 4.

As clearly shown in FIGS. 4–6 and described above, secondary seal 7 includes a pair of connection members 115, 117 at each connection zone 82. Therefore a plurality of paired connection members 115, 117 that are spaced along the length of secondary seal 7 are used to mount secondary seal 7 about the entire perimeter of a section of dike portion 15 by inserting each associated pair of connection members 115, 117 into a corresponding hole 126 in dike portion 15. When secured in this manner, dike portion 15 is retained between first leg 89 and engagement surfaces 124 and 125 and the concave shape of body portion 109 is flattened to a degree such that first and second ends 103, 106 are compressed against dike portion 15, as best shown in FIG. 3.

As should be readily evident from viewing FIG. 9, secondary seal 7 has a configuration between successive connection zones 82 which is similar in cross-section to that described above with respect to FIG. 7, however, the pliable connection members 115 and 117 are missing. Instead, between each connection zone 82, along horizontal and vertical extending portions 76 and 78, stub support members 126 and 127 project from body portion 109. With this arrangement, when secondary seal is secured to dike portion 15, stub support members 126 and 127 are also pressed against dike portion 15 in a manner similar to first and second ends 103, 106. In this fashion, secondary seal 7 is supported against dike portion 15 in a manner which controls undesired relative movement therebetween.

At notches 84, secondary seal 7 evinces a cross-section such as that illustrated in FIG. 10. In general, the cross-sectional configuration of secondary seal 7 at each notch 84 is identical to that discussed above with reference to FIG. 9 with the exception that second leg 92 is truncated adjacent vertex defining portion 95.

By comparing the positions of primary and secondary seals 4, 7 as they are moved from non-sealing to sealing positions as depicted in FIGS. 2 and 3, respectively, the amount of shifting of first seal element 64, along with the degree of deflection of second seal element 67 and second leg 92 of secondary seal, should be readily apparent. Flap members 72 and 74 permit first seal element 64 to shift into engagement with face portion 32 of cabinet shell 31 due to the magnet attraction therebetween while second seal element 67 sealingly engages forward corner 35. At the same time, second leg 92 of secondary seal 7 is deflected by a distance B by its engagement with liner 34. Moreover, distance B is in the range of 0.060 to 0.170 of an inch. In a preferred embodiment, end 98 of second leg 92 engages second seal element 67 when in its sealing position. In the sealed condition shown in FIG. 3, an air cell 128 is formed that shields primary seal 4 and-a portion of throat area 44 from the cold refrigerator compartment temperatures.

The seal assembly 1 of the present invention as described above substantially minimizes heat transfer through the door seal and therefore effectively contributes to the overall energy efficiency of the refrigerator. Of particular importance in this arrangement is the design, construction and operation of secondary seal 7. By utilizing the V-shaped design and providing the secondary seal 7 in throat area 44 around the entire perimeter of dike portion 15, energy consumption of the refrigerator is substantially reduced. Secondary seal 7 is specifically designed to minimize closing forces, allow for manufacturing variations, provide for minimum wear during service life, allow for ease of manufacturing and minimize the accumulation of condensate. As shown, secondary seal 7 appears as a cosmetic extension of primary seal 4. In fact, it is even possible to form the two seals as an integral unit.

The specific construction of secondary seal 7, which enables the above-stated characteristics to be achieved, will now be explained. As previously stated herein, it is important that the inclusion of secondary seal 7 does not significantly add to the required closing force of door 10. It has been determined that the force range that meets the necessary incremental closing criteria is within the range of essentially 0 to 2¼ lbs. To achieve this closing force and enable the magnet housed within first seal element 64 to be able to close the door by itself, and to provide a proper seal between second leg 92 of secondary seal 7 and cabinet liner 34 while preventing second leg 92 from curling back on itself, the angle between first leg 89 and second leg 92 of secondary seal 7 is preferably between 40°–50°. The radius of curvature between second leg 92 and first leg 89 is approximately 0.045 of an inch +0.005 of an inch and the thickness of second leg 92 is between approximately 0.015–0.025 of an inch to meet the flexibility requirements. The physical properties providing secondary seal 7 with flexibility and strength at low temperatures of approximately 5°–10° F. include a 12,600/12,200 psi flexural modulus and a compression set of 45/54%. It has been found that materials which afford these properties include resins, such as ELVAX 265, a copolymer of ethylene and vinyl acetate with 28% by weight TGA made by Dupont having a melt index of 3.0 degrees/minute and a blend of kememide. Of course, other materials with similar physical characteristics could also be utilized.

In addition, it has been found extremely important in accordance with the present invention to form corner sections 80 with notches 84 and cantilevered arms 86 in order to ensure that the magnet provided within first seal element 64 will be able to overcome the frictional forces generated as secondary seal 7 engages liner 34 during closing of door 10. Due to the geometry and structural integrity of the corners of such a seal, extreme forces can be generated which may prevent the magnet from providing the desired closing force. Due to this tapering slope of cabinet liner 34, as door 10 approaches its final closed position, the resistance to closing also increases. If corner sections 80 are not provided with notches 84, it has been found that second leg 92 does not simply act as a cantilevered arm and, with a constant corner geometry, the structural integrity of second leg 92 will generate a force at the corners which is much greater than the magnet in the primary seal 4 can overcome. In such a situation, door 10 will remain ajar unless an additional closing force is added to compensate for this additional resistance. This will defeat a primary object of the present invention concerning the providing of an associated low closing force with the seal assembly. This problem is overcome by providing notches 84 which changes the structural behavior of corner sections 80 from a rigid member to a series of cantilevered arms 86. The presence of cantilevered arms 86 reduce the stiffness of each corner section 80. The notches 84 also provide the necessary clearance that arms 86 need as to not overlap with each other as they are deflected and compressed during the closing of refrigerator door 10.

Although described with respect to a preferred embodiment of the invention, it should be readily apparent that various changes and/or modifications may be made without departing from the spirit of the invention. For instance, although a specific type of connector has been disclosed for securing secondary seal 7 to dike portion 15, it should be readily understood that various other types of connection arrangements could also be utilized. In addition, although secondary seal 7 has been disclosed as being fixedly secured to dike portion 15 with second leg 92 engaging cabinet liner 34, this arrangement could be reversed, in which case, second leg 92 would extend in the opposite direction to that shown in FIGS. 2 and 3. It is important to note that in order to gain a maximum energy benefit, secondary seal 7 is preferably continuous in design as described above in order to seal the entire perimeter between door 10 and cabinet liner 34.

We claim:

1. In a refrigerator having a cabinet shell, a shell liner, at least one door connected for pivotal movement relative to the cabinet shell between open and closed positions and a door liner secured to the door wherein, when the door is closed, an annular throat area is defined between the shell liner and a dike portion of the door liner, a seal assembly comprising:

a primary seal disposed between said door and at least one of said cabinet shell and said shell liner; and a secondary seal including generally horizontal and vertical extending portions interconnected by corner sections, each of said corner sections being defined by a plurality of cantilevered arms that are spaced by respective notches, said secondary seal being disposed within said throat area between said door liner and said shell liner, said secondary seal including first and second legs interconnected by a vertex portion, said first leg being secured to one of said door and shell liners at spaced intervals and said second leg being deflectable relative to said first leg from a non-sealing position to a sealing position upon contact with the other of said door and shell liners when said door is closed.

2. The seal assembly of claim 1, wherein the first leg of said secondary seal is secured to the dike portion of said door liner.

3. The seal assembly of claim 2, wherein said secondary seal extends around the entire perimeter of said dike portion.

4. The seal assembly of claim 1, wherein the first and second legs of said secondary seal and said vertex portion define a substantially V-shaped cross-section.

5. The seal assembly of claim 4, wherein the angle between the first and second legs is approximately 40 to 50 degrees.

6. The seal assembly of claim 1, wherein the second leg of said secondary seal terminates in an end portion remote from said vertex portion, the end portion curling towards the first leg of said secondary seal.

7. The seal assembly of claim 6, wherein the end portion of said second leg abuts said primary seal when said door is closed.

8. The seal assembly of claim 6, wherein said first leg includes first and second ends interconnected by a body portion that is concave-shaped in cross-section.

9. The seal assembly of claim 8, further including at least one connection element depending from the body portion of said first leg for securing said secondary seal to said one of said door and shell liners.

10. The seal assembly of claim 9, wherein said at least one connection element comprises first and second pliable connection members.

11. The seal assembly of claim 10, wherein said connection members are substantially parallel and define an elongate gap therebetween.

12. The seal assembly of claim 11, wherein the first leg of said secondary seal is fixedly secured to the dike portion of said door liner.

13. The seal assembly of claim 12, wherein each of said connection members includes a flared end portion such that said dike portion is positioned between the flared end portions of said connection members and the first leg of said secondary seal.

14. The seal assembly of claim 13, wherein the body portion of said first leg assumes a flattened concave-shaped in cross-section when secured to said dike portion with the first and second ends of said first leg being biased into sealing engagement with said dike portion.

15. The seal assembly of claim 1, wherein the incremental force required to deflect the second leg of said secondary seal upon closing the door is within the range of approximately essentially 0 to 2¼ lbs.

16. The seal assembly of claim 1, wherein, from said non-sealing position to said sealing position, said second leg deflects within the range of approximately 0.060 to 0.170 of an inch.

17. The seal assembly of claim 1, wherein the second leg of said secondary seal has a thickness within the range of approximately 0.015 to 0.025 of an inch.

18. In a refrigerator door having a cabinet shell, a shell liner, at least one door connected for pivotal movement relative to the cabinet shell between open and closed positions and a door liner secured to the door wherein, when the door is closed, a throat area is defined between the shell liner and a dike portion of the door liner, a seal assembly comprising:

a primary seal disposed between said door and at least one of said cabinet shell and said shell liner; and a secondary seal disposed within said throat area between said door liner and said shell liner, said secondary seal including first and second legs interconnected by a vertex portion, the second leg of said secondary seal terminating in an end portion remote from said vertex portion, said first leg being secured to one of said door and shell liners, said second leg being deflectable relative to said first leg from a non-sealing position upon contact with the other of said door and shell liners when said door is closed and the end portion of said second leg abuts said primary seal when said door is closed.

19. The seal assembly of claim 18, wherein the end portion of said second leg curls toward the first leg of said secondary seal.

20. The seal assembly of claim 19, wherein the first leg of said secondary seal is secured to the dike portion of said door liner.

* * * * *

UNITED STATES PATENT AND TRADEMARK OFFICE

CERTIFICATE OF CORRECTION

PATENT NO. : 5,551,192
DATED : September 3, 1996
INVENTOR(S) : Jose G. Avendano et al It is certified that error appears in the above-indentified patent and that said Letters Patent is hereby corrected as shown below:

In the Drawings:

In Figures 9 and 10, "126" should read -- 128 --

In Column 2, line 10, "Addition" should read -- Additional --
In Column 3, line 1, "shell" should read -- liner --
In Column 4, line 24, "126 and 127" should read -- 127 and 128 --
In Column 4, line 26, "126 and 127" should read -- 127 and 128 --

In Column 7, line 7, "concave-shaped" should read -- concave-shape --

Signed and Sealed this
Eleventh Day of February, 1997

Bruce Lehman

*Attest:*

BRUCE LEHMAN

*Attesting Officer*

*Commissioner of Patents and Trademarks*